United States Patent [19]

Harper

[11] Patent Number: 4,829,614

[45] Date of Patent: May 16, 1989

[54] ADJUSTABLE PILLOW WITH NECK SUPPORT

[76] Inventor: James A. Harper, Rte. 3, Box 25, Camden, Tenn. 38320

[21] Appl. No.: 229,621

[22] Filed: Aug. 8, 1988

[51] Int. Cl.[4] ..... A47C 20/02

[52] U.S. Cl. ..... 5/436; 5/441

[58] Field of Search ..... 5/434, 436, 437, 441, 5/442, 490, 450, 455, 449; 297/DIG. 3

[56] References Cited

U.S. PATENT DOCUMENTS

| | | | |
|---|---|---|---|
| 2,880,428 | 4/1959 | Forsland | 5/436 |
| 2,942,281 | 6/1960 | Cole | 5/441 |
| 4,042,988 | 8/1977 | Holliday | 5/450 |
| 4,424,599 | 1/1984 | Hannouche | 5/436 |
| 4,501,034 | 2/1985 | Greenawalt | 5/441 |

FOREIGN PATENT DOCUMENTS

| | | | |
|---|---|---|---|
| 609850 | 3/1979 | Switzerland | 297/DIG. 3 |

*Primary Examiner*—Gary L. Smith
*Assistant Examiner*—Michael F. Trettel
*Attorney, Agent, or Firm*—Herbert L. Bello

[57] ABSTRACT

An adjustable pillow with adjustable neck support having a main portion and a neck support portion. A plurality of separately inflatable members positioned in chambers that are surrounded and separated by cushioning material. One of the chambers formed in the neck support portion and the other chambers formed in the main portion. One of the main portion chambers is in substantial vertical alignment with the neck support portion chamber. Each inflatable member is configured to be inflated and deflated to an infinite number of pressures for controlling the firmness of support provided by the pillow and neck support.

18 Claims, 2 Drawing Sheets

ADJUSTABLE PILLOW WITH NECK SUPPORT

BACKGROUND OF THE INVENTION

1. Field of the Invention

The present invention relates to support pillows and, more particularly, is directed towards an adjustable pillow with a neck support.

2. Description of the Prior Art

There are many pillows and similar devices which provide support for the neck. Heretofore, all of the various products described or invented, although of benefit, have lacked one or more inventive features necessary for optimum comfort. For example, U.S. Pat. No. 3,644,949 describes generally a wedge-shape pillow with multiple inflatable chambers, but it lacks the external cushioning and the air chamber spacig material as well as the combination of horizontally and vertically positioned adjustable air chambers needed for maximum support of the head and neck area.

U.S. Pat. No. 2,896,227 describes a pillow having inflatable chambers with a neck support, but it lacks multiple air chambers in the horizontal section, particularly below the vertical neck support.

U.S. Pat. No. 4,501,034 discloses a substantially rectangular pillow with inflatable chambers.

U.S. Pat. No. 3,753,264 discloses a foam pillow with air chambers and partition walls of particular configurations that provide a specific force distributions for enhancing blood flow to the scalp and nourishment of hair roots.

U.S. Pat. No. 2,521,780 discloses a cushion with a vertical neck support comprised of a single inflatable chamber.

A need exists for an adjustable pillow that supports the head, neck, and upper shoulder area.

SUMMARY OF THE INVENTION

It is an object of the present invention to provide an adjustable pillow with integrated neck support and multiple air chambers which are surrounded and separated by cushioning material.

It is a further object of the present invention is to provide an adjustable pillow for sleeping or resting that separately supports the head, neck and upper shoulder.

Another object of the invention is to provide an adjustable pillow and neck support that can be adjusted to suit the taste and shapes of an individual user. The pillow includes a body having a main portion and a neck support portion adjacent one end of the main portion. The main portion is formed with a plurality of laterally extending chambers and the neck portion is formed with one chamber. One of the chambers and the main portions is in substantial vertical alignment with the chamber in the neck support portion. The chambers are separated and surrounded by a cushioning material. An inflatable member is disposed in each of the chambers.

The invention accordingly comprises the apparatuses and systems, together with their parts, elements and interrelationships that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
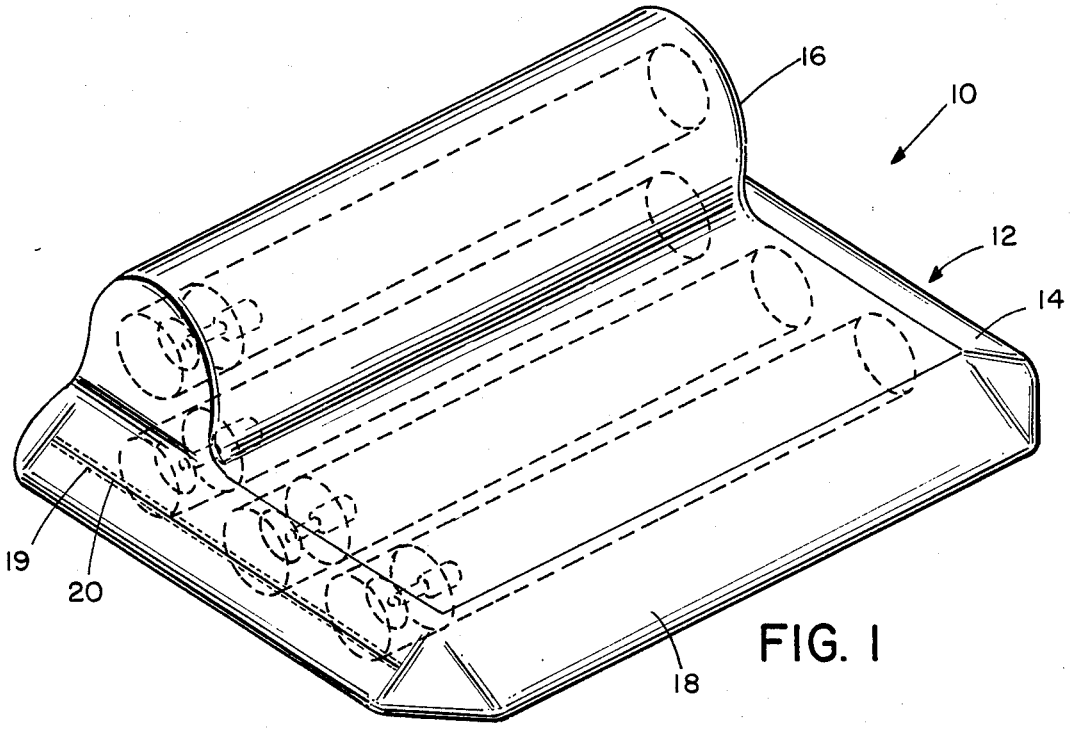
FIG. 1 is a perspective view of an adjustable pillow and neck supporting embodying the invention.

Referring now to the drawings, particularly FIG. 1, there is shown an adjustable pillow and neck support 10 embodying the present invention. Adjustable pillow and neck support 10 includes an integral body 12 having main portion 14 and a neck support portion 16. Pillow and neck support 10 is cover with a cover 18 composed of a material such as a blend of cotton and polyester, for example, 20 percent cotton and 80 percent polyester. Cover 18 has an opening 19 that is closed by a closure member 20, for example a zipper 20. Opening 19 is provided for removing the cover for cleaning and for exposing inflatable members 22, 24, 26 and 28 shown in FIG. 2.

Figure 3:
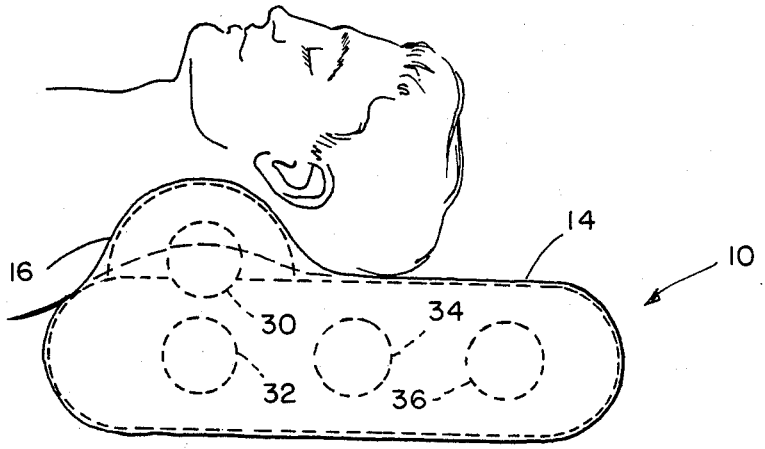
FIG. 3 is a side elevation showing the inflatable members.
Figure 2:
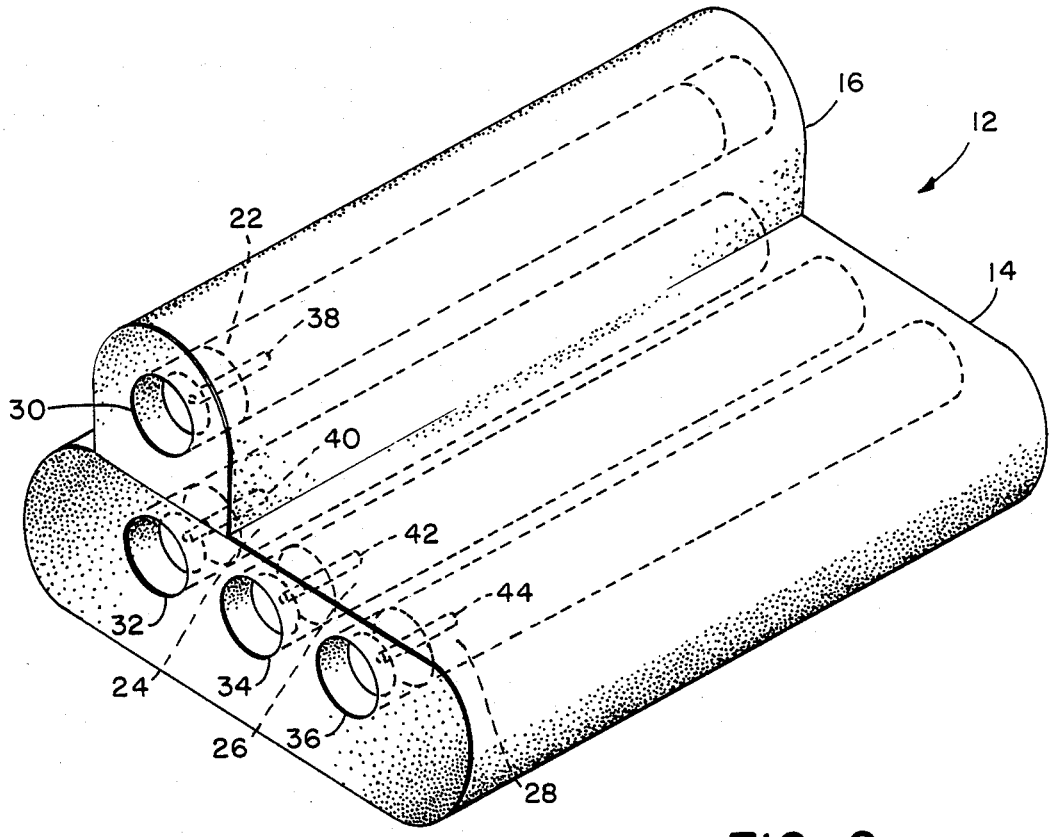
FIG. 2 is a perspective view of the adjustable pillow and neck support of FIG. 1 with the cover removed.

As best shown in FIG. 2, neck support portion 16 is formed on the upper surface of main portion 14 and is located adjacent one end of body 12. The section of main portion 14 between neck support portion 16 and the other end of main body 12 is configured to support a person's head (FIG. 3) and the neck support portion is configurated to support the person's neck. In the preferred embodiment, body 12 is composed of a soft foam rubber, for example.

Body 12 is formed with laterally extending chambers 30, 32, 34 and 36. Chamber 30 is formed in neck portion 16 and chambers 32, 34 and 36 are formed in main portion 14. Chamber 30 and chamber 32 are in substantial vertical alignment. Inflatable members 22, 24 26 and 28 are received within chambers 30, 32, 34 and 36, respectively. Inflatable members 22, 24, 26 and 28 are provided with valves 38, 40, 42 and 44, respectively, for inflating and deflating the inflatable members. In the preferred embodiment, valves 38, 40, 42 and 44 are retractable valves.

In the preferred embodiment, chambers 30, 32, 34 and 36 are substantially cylindrical chambers that extend the width of body 12. Inflatable members 22, 24, 26 and 28 are cylindrical members that are configured to be received in chambers 30, 32, 34 and 36, respectively, and extend substantially the width of body 12. Each inflatable member 22, 24, 26 and 28 is a sealed member that is configured to be inflated to an infinite number of pressures for controlling the firmness of the support provided by neck support portion 16 and main portion 14. In the illustrated embodiment, each inflatable member 22, 24, 26 and 28 is composed of a flexible plastic, for example, polyvinylchloride.

Although four chambers and four inflatable members are shown, it is to be understood that the number of chambers and inflatable members is other than four, for example three. In this configuration, two chambers are formed in the main portion 14 and one chamber is formed in the neck support position 16, one of the main portion chambers being in substantial vertical alignment with the chamber formed in the neck support portion.

In operation, zipper 20 is opened and inflatable members 22, 24, 26 and 28 are exposed. The inflatable members 22, 24, 26 and 28 are inflated and deflated by means of valves 38, 40, 42 and 44, respectively to a specific pressure for controlling the firmness provided by pillow and neck support 10. Inflatable member 22 controls the firmness of the neck support portion 16 and inflatable members 24, 26 and 28 control the firmness of main portion 14. In the illustrated embodiment, inflatable members 22 and 24 control the firmness of support provided to the back of the person's neck and inflatable member 26 controls the firmness of support provided to the back of the neck. The combination of independent and infinitely adjustable inflatable members 22, 24, 26 and 28 that are surrounded by soft foam body 12 provides individualized support for the neck, head and upper shoulders.

Since certain chambers may be made in the foregoing disclosure without departing from the scope of the invention herein invloved, it is intended that all matter contained in the above description and depicted in the accompanying drawings be construed in an illustrative and not in a limiting sense.

What is claimed is:

1. An adjustable pillow with an adjustable neck support, said pillow comprising:

(a) a body having a main portion and a neck support portion, said neck support portion formed on an upper surface of said main portion adjacent one end thereof, a portion of said main portion between said neck support portion and an opposite end of said main portion being configured to support a person's head, said neck support portion configured to support the person's neck;

(b) at least three chambers formed in said body, one of said chambers formed in said neck support portion and the other ones of said chambers formed in said main portion, said chamber formed in said neck portion is in substantial vertical alignment with one of said chambers formed in said main portion; and (c) a plurality of inflatable members, each said inflatable members configured to be received in one of said chambers, each said inflatable member configured to be inflated to a specific pressure to control the firmness of support provided by said neck support portion for the person's neck and by said main portion for the person's head.

2. The pillow as claimed in claim 1 wherein each said chamber is a substantially cylindrical transverse opening formed in said body.

3. The pillow as claimed in claim 2 wherein each said inflatable member is a substantially cylindrical sealed member, an inflation valve provided at an end of each said inflatable member for inflating and deflecting said inflatable member.

4. The pillow as claimed in claim 1 including a cover fitted over said body.

5. The pillow as claimed in claim 4 wherein said cover is formed with an opening for removing said cover and for exposing said inflatable members, closure means are provided for closing said cover opening.

6. The pillow as claimed in claim 4 wherein said cover is composed of a cotton and polyester blend.

7. The pillow as claimed in claim 1 wherein said body is composed of foam rubber.

8. The pillow as claimed in claim 1 wherein each said inflatable member is composed of a flexible plastic material.

9. The pillow as claimed in claim 1 wherein the number of chambers is four, one of said chambers formed in said neck support portion and the other ones of said chambers formed in said main portion.

10. An adjustable pillow with an adjustable neck support, said pillow comprising:

(a) a body having a main portion and a neck support portion, said neck support portion formed adjacent one end of said body, a portion of said main portion between said neck support portion and an opposite end of said body being configured to support a person's head, said neck support portion configured to support the person's neck;

(b) at least three chambers formed in said body, one of said chambers formed in said neck support portion and the other ones of said chambers formed in said main portion, said chamber formed in said neck support portion is in substantial vertical alignment with one of said chambers formed in said main portion; and (c) a purality of inflatable members, each of said inflatable members configured to be received in one of said chambers, each said inflatable member configured to be inflated to an infinite number of pressures for controlling the firmness of support provided by said neck support portion for the person's neck and by the main portion for the person's head.

11. The pillow as claimed in claim 10 wherein each said inflatable member is a substantially cylindrical transverse opening formed in said body.

12. The pillow as claimed in claim 11 wherein each said inflatable member is a substantially cylindrical sealed member, an inflation valve is provided at one end of each said inflatable member for inflating and deflating said inflatable member.

13. The pillow as claimed in claim 10 including a cover fitted over said body, said cover having an opening for removing said cover and for exposing said inflatable members.

14. The pillow as claimed in claim 13 wherein said cover is composed of a cotton and polyester blend.

15. The pillow as claimed in claim 14 wherein said body is composed of foam rubber.

16. The pillow as claimed in claim 15 wherein each said inflatable member is composed of a flexible plastic material.

17. The pillow as claimed in claim 16 wherein the number of chambers is four, one of said chambers formed in said neck support portion and the other ones of said chambers formed in said main portion.

18. An adjustable pillow with an adjustable neck support, said pillow comprising:

(a) a body having main portion and a neck support portion, said neck support formed on an upper surface of said main portion adjacent one end thereof, a portion of said main portion between said neck support portion and an opposite end of said main portion being configured to support a person's head, said neck support portion configured to support the person's neck;

(b) four chambers formed in said body, one of said chambers formed in said neck support portion and the other ones of sid chambers formed in said main portion, one of said main portion chambers is substantially in vertical alignment with said neck support portion chamber; and (c) a plurality of inflatable members, each said inflatable members configured to be received in one of said chambers, each said inflatable member configured to be inflated to a specific pressure to control the firmness of support provided by said neck support portion for the person's neck and by said main portion for the person's head.

* * * * *

UNITED STATES PATENT AND TRADEMARK OFFICE

CERTIFICATE OF CORRECTION

PATENT NO. : 4,829,614

DATED : May 16, 1989

INVENTOR(S) : James A. Harper

It is certified that error appears in the above-identified patent and that said Letters Patent is hereby corrected as shown below:

Claim 3, column 3, line 52, change "deflecting" to --deflating--

Claim 18, column 4, line 58, change "sid" to --said--

Signed and Sealed this

Sixteenth Day of January, 1990

*Attest:*

JEFFREY M. SAMUELS

*Attesting Officer*

*Acting Commissioner of Patents and Trademarks*